US006672463B2

(12) United States Patent
Dashefsky

(10) Patent No.: US 6,672,463 B2
(45) Date of Patent: Jan. 6, 2004

(54) HAIR ACCESSORY DISPLAY AND STORAGE ORGANIZER

(75) Inventor: Daynin J. Dashefsky, Kailua, HI (US)

(73) Assignee: Deico LLC, Kailua, HI (US)

( * ) Notice: Subject to any disclaimer, the term of this patent is extended or adjusted under 35 U.S.C. 154(b) by 0 days.

(21) Appl. No.: 10/081,907

(22) Filed: Feb. 20, 2002

(65) Prior Publication Data

US 2002/0112736 A1 Aug. 22, 2002

Related U.S. Application Data

(60) Provisional application No. 60/270,945, filed on Feb. 20, 2001.

(51) Int. Cl.[7] ..... A47F 7/00

(52) U.S. Cl. ..... 211/13.1; 211/70; 211/78; 211/84; 211/163

(58) Field of Search ..... 211/13.1, 10, 85.2, 211/85.3, 1.52, 1.53, 163, 78, 70, 131.1, 83, 84; 132/286, 314, 333; D6/329, 396, 411–415, 436, 441, 449, 450, 457, 458, 462, 470, 472; D3/25, 271; D28/73–77, 79, 99; D20/3, 4, 29, 36, 38; 312/114, 117, 118, 128, 138.1, 204, 234, 237, 280, 283–285, 97.1, 123, 125, 135, 136

(56) References Cited

U.S. PATENT DOCUMENTS

| | | | | | |
|---|---|---|---|---|---|
| 413,872 | A | * | 10/1889 | Shipman | 312/135 |
| 763,291 | A | * | 6/1904 | Klayman | 312/118 |
| 1,566,860 | A | * | 12/1925 | Hainzigianis | 206/362.1 |
| 1,597,142 | A | * | 8/1926 | Carlson | 312/129 |
| 1,807,400 | A | * | 5/1931 | Gallagher | 221/121 |
| D111,982 | S | * | 11/1938 | Kushner | D6/457 |
| 2,136,843 | A | * | 11/1938 | Dinkel | 312/280 |
| D167,922 | S | * | 10/1952 | Blauvelt | D9/347 |
| D194,466 | S | * | 1/1963 | Johnson | D6/414 |
| D203,025 | S | * | 11/1965 | Pietrowiak | D3/25 |
| D235,594 | S | * | 7/1975 | Cohn | D6/453 |
| 4,030,608 | A | * | 6/1977 | Howard | 211/131.1 |
| 4,225,201 | A | * | 9/1980 | Davis | 312/125 |
| 4,850,658 | A | * | 7/1989 | Sandor | 312/225 |
| 5,031,777 | A | * | 7/1991 | Knox | 211/85.3 |
| D329,153 | S | * | 9/1992 | Kijanka et al. | D6/467 |
| 5,168,985 | A | * | 12/1992 | Shih | 206/6.1 |
| D332,632 | S | * | 1/1993 | Camasi | D19/90 |
| 5,425,971 | A | * | 6/1995 | Chiang-Cheng | 428/28 |
| 5,663,746 | A | * | 9/1997 | Pellenberg et al. | 345/581 |
| 5,673,802 | A | * | 10/1997 | Valentino | 211/70 |
| 6,158,578 | A | * | 12/2000 | Greiner | 206/6.1 |
| 6,241,105 | B1 | * | 6/2001 | Pomper | 211/85.2 |
| 6,305,534 | B1 | * | 10/2001 | Neal | 206/315.11 |
| D456,176 | S | * | 4/2002 | Dashefsky | D6/450 |

FOREIGN PATENT DOCUMENTS

| | | | | |
|---|---|---|---|---|
| IT | 339524 | * | 6/1936 | 211/70 |

* cited by examiner

*Primary Examiner*—Daniel P. Stodola
*Assistant Examiner*—Jennifer E. Novosad
(74) *Attorney, Agent, or Firm*—Martin E. Hsia

(57) ABSTRACT

A hair accessory storage, display, and organizing device having a plurality of storage compartments, a centrally mounted hollow member and a plurality of pillars for the display and storage of a wide variety of various hair accessories.

7 Claims, 6 Drawing Sheets

HAIR ACCESSORY DISPLAY AND STORAGE ORGANIZER

This application claims priority under 35 U.S.C. §119(e) to U.S. Provisional Application Ser. No. 60/270,945 filed on Feb. 20, 2001.

TECHNICAL FIELD

This invention relates to the field of hair accessory organizers, and specifically relates to a device for storing, displaying, and organizing hair accessories, preferably having a plurality of storage compartments, a central hollow member that solely supports a removable top, and preferably removably lockable pillars. Optionally, a music player or a motor are provided so that the device rotates and plays music.

BACKGROUND ART

Hair accessories are used for grooming, styling, and generally giving a person's hair a more attractive appearance. Common hair accessories include barrettes, clamps, scrunchies, combs, various pins, and elastic bands. It is not unusual to find large quantities of these hair accessories on a female's dresser or bathroom counter. Although fashion conscious women in particular have historically been the largest purchasers and users of hair accessories, it is now common to find younger women, including teenagers and children, purchasing and using numerous and various hair accessories. There are males who use hair accessories as well, but probably not as commonly as females. This does not, however, prevent a male from using the present invention, should he so desire.

Hair accessories, such as scrunchies and decorative hair clips in particular, have become popular among females, especially teenage and young girls. Storage and organization of hair accessories, especially large quantities of them, presents a problem to most wearers. Usually, hair accessories are not organized at all, thereby cluttering valuable dresser, counter, and drawer space. More commonly, hair accessories are collectively stored in a box, which makes finding a particular hair accessory difficult. Many hair accessories contain decorative elements, and these decorative elements may be difficult to see if hair accessories are not stored in an organized manner.

It is therefore an object of the present invention to provide a device for the storage, display, and organization of a wide variety of hair accessories.

It is a further object of the present invention to provide a device for the storage, display, and organization of a wide variety of hair accessories that will appeal to young children, especially female children.

It is a still further object of the present invention to provide a device that allows easy placement in, and removal from, storage of a wide variety of hair accessories.

It is a still further object of the present invention to provide a device for the storage, display, and organization of a wide variety of hair accessories that is inexpensive to manufacture.

DISCLOSURE OF INVENTION

These and other objects are achieved by a device having a base, a top plate preferably rotatably mounted on the base, a removable top preferably solely supported above the base by a hollow member substantially centrally mounted on the top plate, and a plurality of pillars that are spaced apart from each other and each of the pillars being mounted on the top plate, so that a wide variety of hair accessories may be stored, displayed, and organized in the hollow member and on the pillars. Additionally, there may be a plunger located within the hollow member, whereby the plunger can be withdrawn out of the hollow member and extract accessories that have been placed in the hollow member. A plurality of storage compartments where other hair accessories may be stored may also be provided. The top plate can be manually rotated to provide easy accessibility to hair accessories that have been placed on the pillars and in or on the hollow member, which is preferably a tube. Optionally, a motor can be drivingly attached to either the top plate or the base such that the motor rotates the top plate. The device may be optionally fitted with a music player to play pre-recorded music when the top plate rotates.

BEST MODES FOR CARRYING OUT INVENTION

Figure 1:
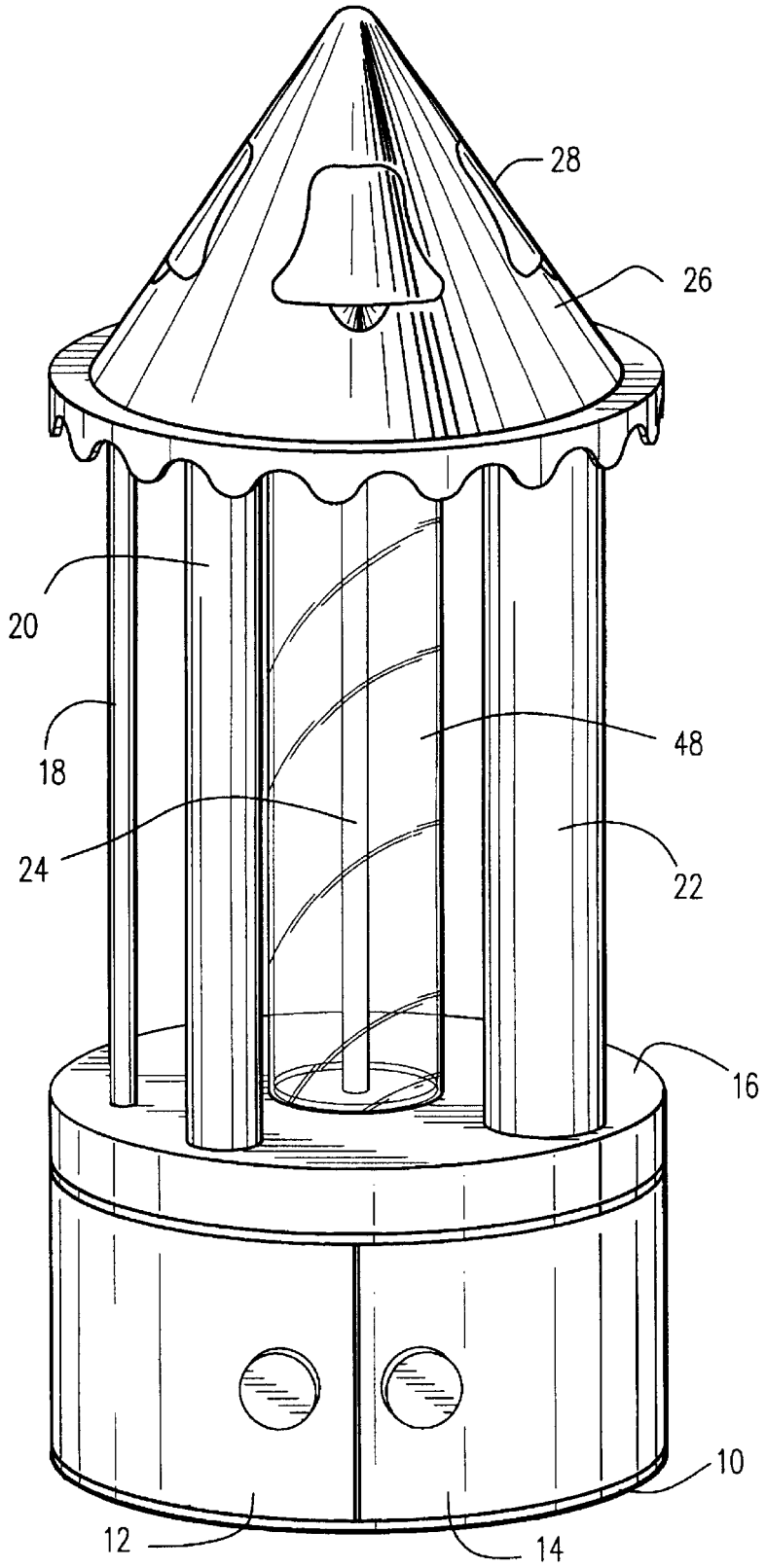
FIG. 1 is a front elevational view of a presently preferred embodiment of the invention.
Figure 2:
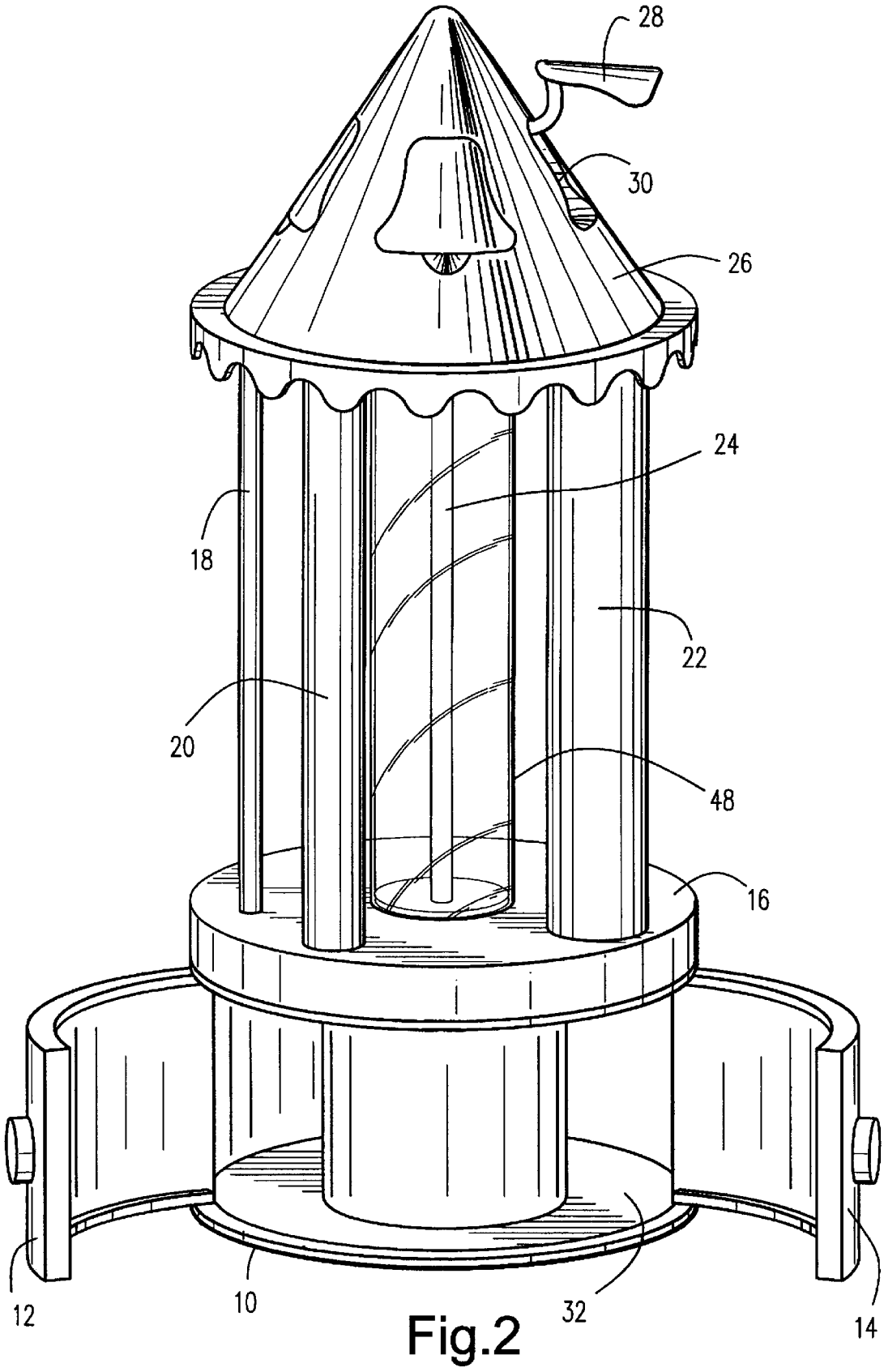
FIG. 2 is a front elevational view of the embodiment of FIG. 1, displaying the storage compartments in the open position.

The presently preferred best mode for carrying out the present invention is illustrated by way of example in FIGS. 1 to 6. Referring to FIG. 1, shown is a presently preferred embodiment of a hair accessory storage, display, and organizing device according to the present invention. The base 10 of the invention is illustrated as a cylinder, but need not be limited to being cylindrical in shape. A top plate 16 is preferably (but not necessarily) rotatably mounted on the base 10. Referring to FIG. 2, the base 10 is preferably hollow, and has at least one base compartment 32 for the storage of large hair accessories such as headbands. Referring to FIGS. 1 and 2, the base compartment 32 is enclosed by doors 12 and 14, which preferably also form the walls of the base 10 when closed.

Referring to FIGS. 1 and 2, the removable top 26 is preferably cone-shaped, but need not be limited to that shape, and preferably contains at least one hatch 28 that leads to a top compartment 30 located in the top 26. This top compartment 30 may be used to store smaller hair accessories such as decorative hair clips and small barrettes. FIGS. 1 and 2 illustrate the present invention with a plurality of hatches and top compartments.

Referring again to FIG. 1, a plurality of pillars 18, 20, and 22, are preferably spaced apart from each other and each of the pillars is preferably mounted to the top plate 16, and not affixed to the removable top 26. The pillars are illustrated as tubes or cylinders, but need not be limited to those shapes. The pillars can be of various sizes, including small 18, medium 20, and large 22 pillars. These pillars are used to store, display and organize a wide variety of hair accessories, for example, by being clipped to or slid over thereon. Referring again to FIG. 1, in addition to pillars, there may also be a preferably transparent hollow member 48 substantially centrally mounted on the top plate 16. The hollow member 48 is illustrated as a tube or cylinder, but it need not be limited to that shape.

Preferably, the hollow member 48 has an open upper end 60. A plunger 24 composed of a rod 44 and a platform 46 that can be inserted inside the hollow member 48 via the open upper end. In use, the plunger 24 would be placed inside the hollow member 48 and hair accessories would be placed over the rod 44. The accessories could be removed by withdrawing the plunger 24, so that the hair accessories could be pulled out by the platform 46. Preferably, the platform 46 is almost co-extensive with the interior cross-section of the hollow member 48.

Figure 3:
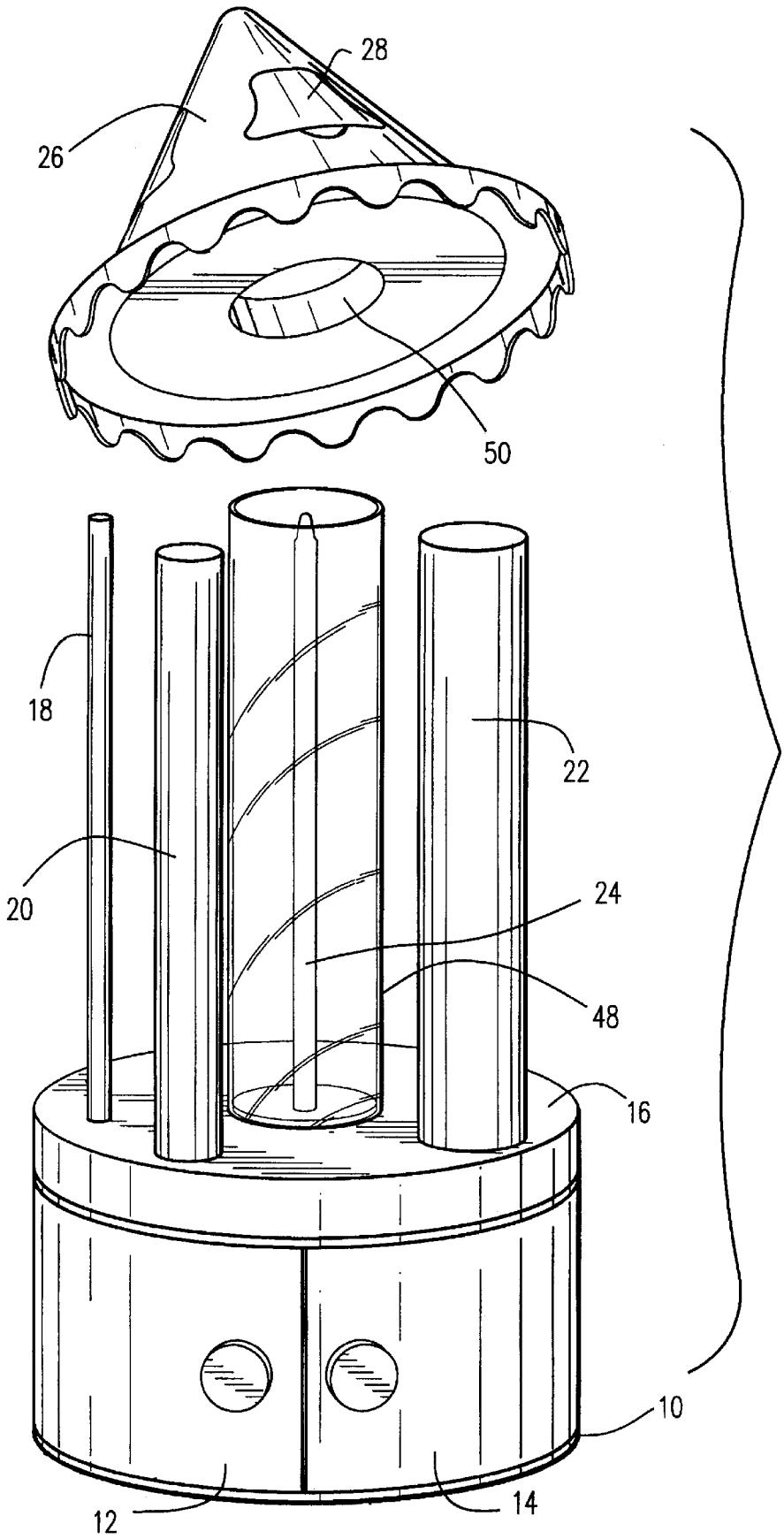
FIG. 3 is a front elevational view of the embodiment of FIG. 1, with the removable top partially removed.
Figure 4:
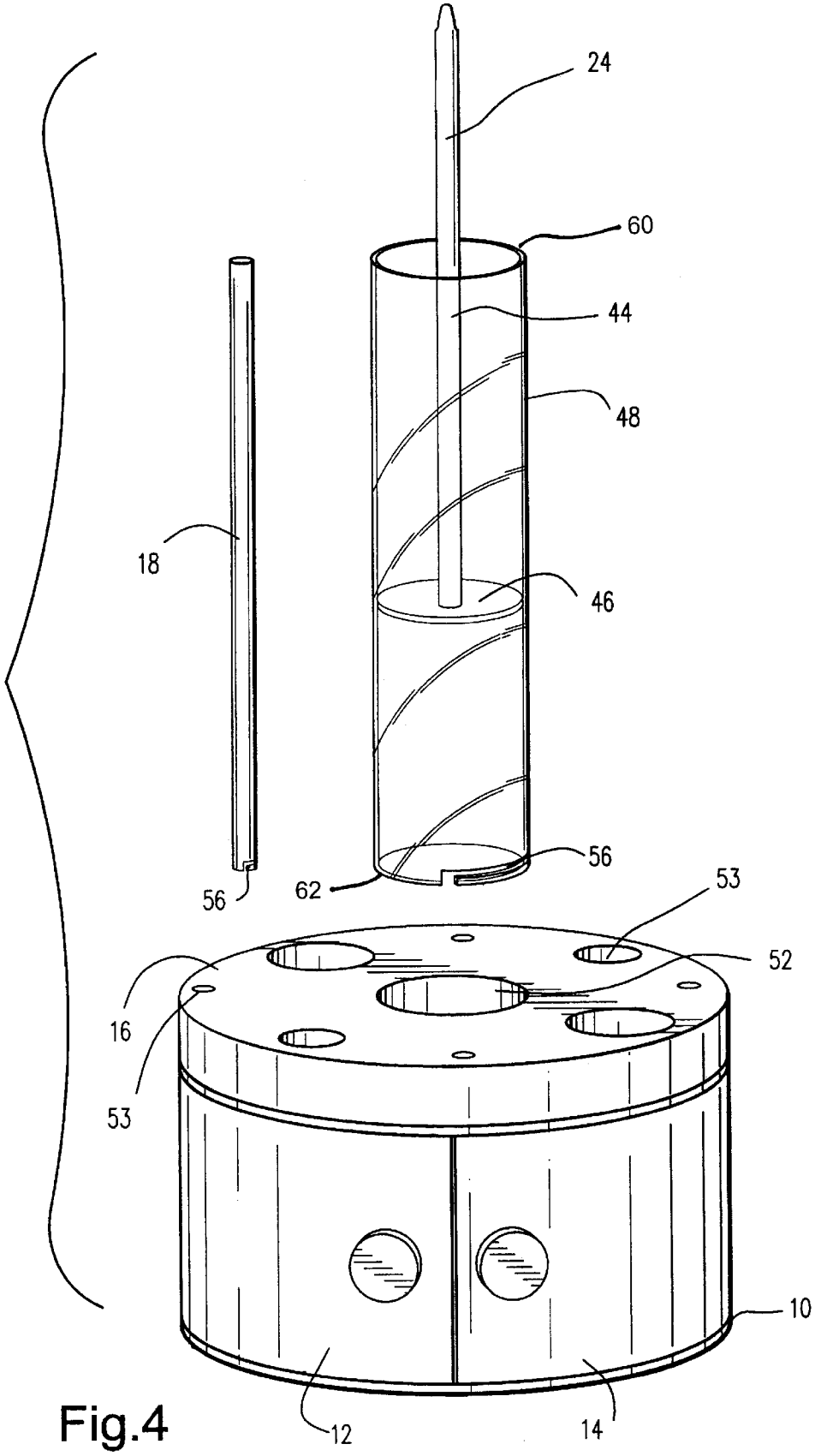
FIG. 4 is a front elevational view of the embodiment of FIG. 1, without the removable top and displaying optionally removably lockable pillar and optionally removably lockable hollow member.

In another presently preferred embodiment of the present invention, the hollow member 48 may be removably mounted to the top plate 16. Referring to FIG. 3, in this alternative embodiment, the hollow member 48 has a lower end 62 and an open upper end 60. Referring to FIG. 4, the top plate 16 has an approximately central recess 52. The lower end 62 of the hollow member 48 is adapted to be received by and retained in the central recess 52. The removable top 26 may then be affixed to the hollow member 48 by placing the removable top 26 in an approximately centered position over the hollow member 48. The hollow member 48 is then inserted in an aperture 50 located approximately in the center of the bottom surface of the top 26. FIGS. 1 and 2 illustrate the invention with the removable top 26 affixed to the hollow member 48. FIG. 3 illustrates the removal of the removable top 26 and the aperture 50. Because the hollow member 48 solely supports the removable top 26, the user only needs to align the removable top 26 with the tube 48 to replace the removable top 26. This is especially desirable because the user may be a young child who may have difficulty aligning the removable top 26 with multiple tubes.

Referring to FIG. 3, a presently preferred embodiment of the invention illustrates the removable top 26 of the invention removed from the hollow member 48, exposing the top ends of the pillars 18, 20, 22, plunger 24, and hollow member 48. Once the removable top 26 is removed, various hair accessories, such as scrunchies and hair bands, can be slid down the pillars 18, 20, and 22, and inserted into the hollow member 48. Alternatively, hair clips can be clamped onto the pillars without removing the removable top 26.

Referring to FIG. 4, the pillars, illustrated by example with a small pillar 18, and tube 48, may also be removably mounted on the top plate 16. In this embodiment of the invention, the top plate 16 has a plurality of outer recesses 53 spaced apart from each other, and each of the outer recesses 53 being located on the top plate. Each of the pillars 18, 20, 22 are preferably adapted to be mounted on the top plate 16 by inserting each of the pillars 18, 20, 22 into an outer recess 53.

Figure 5:
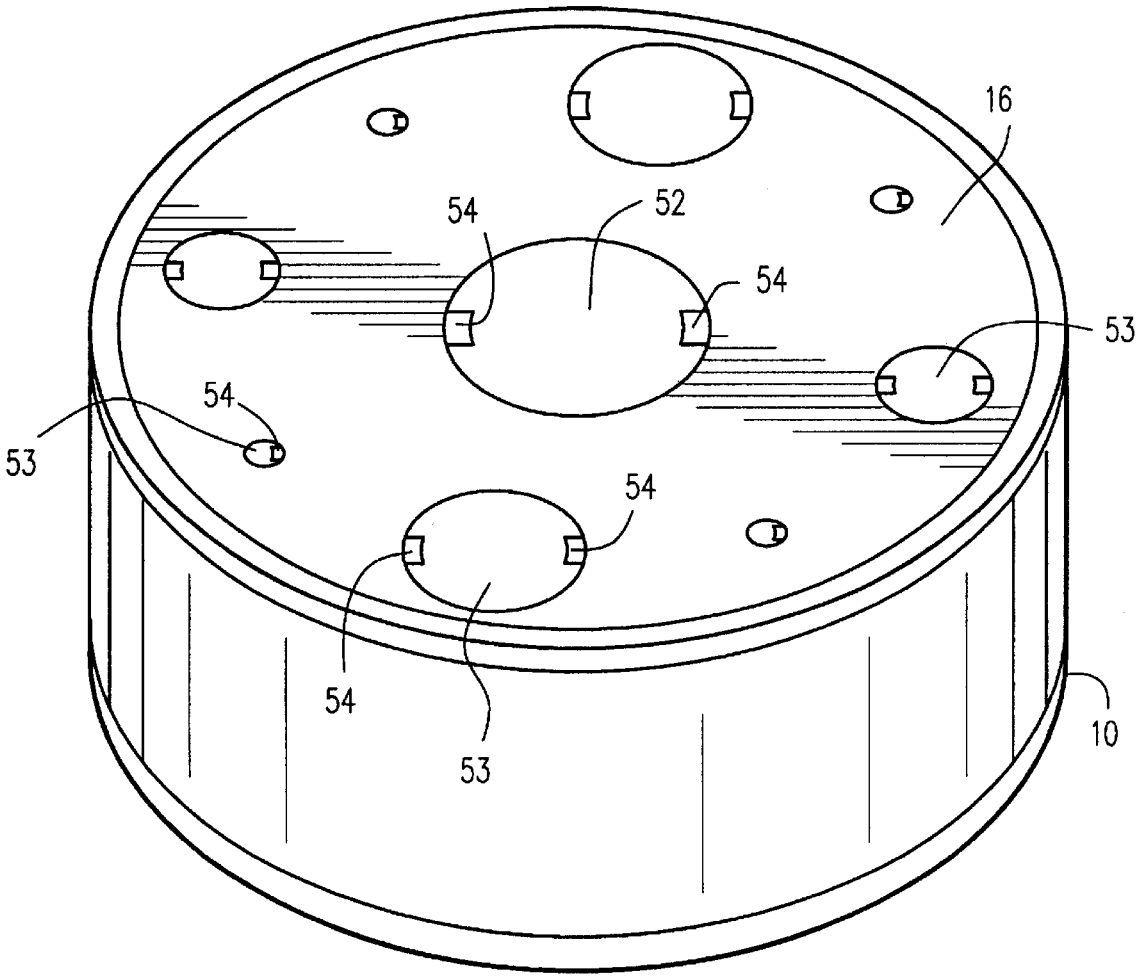
FIG. 5 is a top perspective view of the base of the embodiment of FIG. 1, showing the recesses in the top plate of the base, and the optional locking tabs located in the recesses.

The hollow member 48 and pillars 18, 20, 22 may optionally be adapted to be removably lockably mounted on the top plate 16. In another alternative embodiment of the present invention, the optional locking mechanism (utilizing interlocking tabs and grooves) for the hollow member and pillars is illustrated in FIGS. 4 and 5. However, because the pillars and tube may be removably and lockably affixed to the base in a number of ways, the present invention is not limited to being practiced solely with the tab and groove locking mechanism illustrated in FIGS. 4 and 5. The pillars and tube can be removably and lockably affixed to the top plate 16 by inserting the hollow member into the central recess 52, and inserting the pillars 18, 20, 22 into the outer recesses 53, located on the top plate 16. Referring to FIG. 5, the central recess 52 and each outer recess 53 may contain at least one tab 54 along the inner perimeter of the recesses 52 53. As illustrated in FIG. 5, the central recess 52 and larger outer recesses 53 may contain two or more tabs, while smaller outer recesses 53 may contain only one tab 54. Referring to FIG. 4, the pillars, illustrated by example with a small pillar 18, and hollow member 48 preferably have L-shaped grooves 56 configured to receive the tabs 54, located circumferentially near, but not at, the inserted end of the pillar 18 and hollow member 48, as shown in FIG. 4. After being inserted into the recesses 53, 52 the pillars 18, 20, 22, and hollow member 48 are twisted to engage the tabs 54 into the L-shaped grooves 56, thereby locking pillars 18, 20, 22, and hollow member 48 into their respective recesses 53, 52.

However, in the presently preferred embodiment of the invention, there is no locking mechanism, and the pillars 18, 20, 22, and hollow member 48 may be removably inserted in the recesses 53, 52 in the top plate 16. In yet another alternative embodiment, the pillars 18, 20 and 22 or hollow member 48, may be permanently affixed to the top plate 16. In yet another alternative embodiment, the top plate 16 and the base 10 can be integrally formed.

Figure 6:
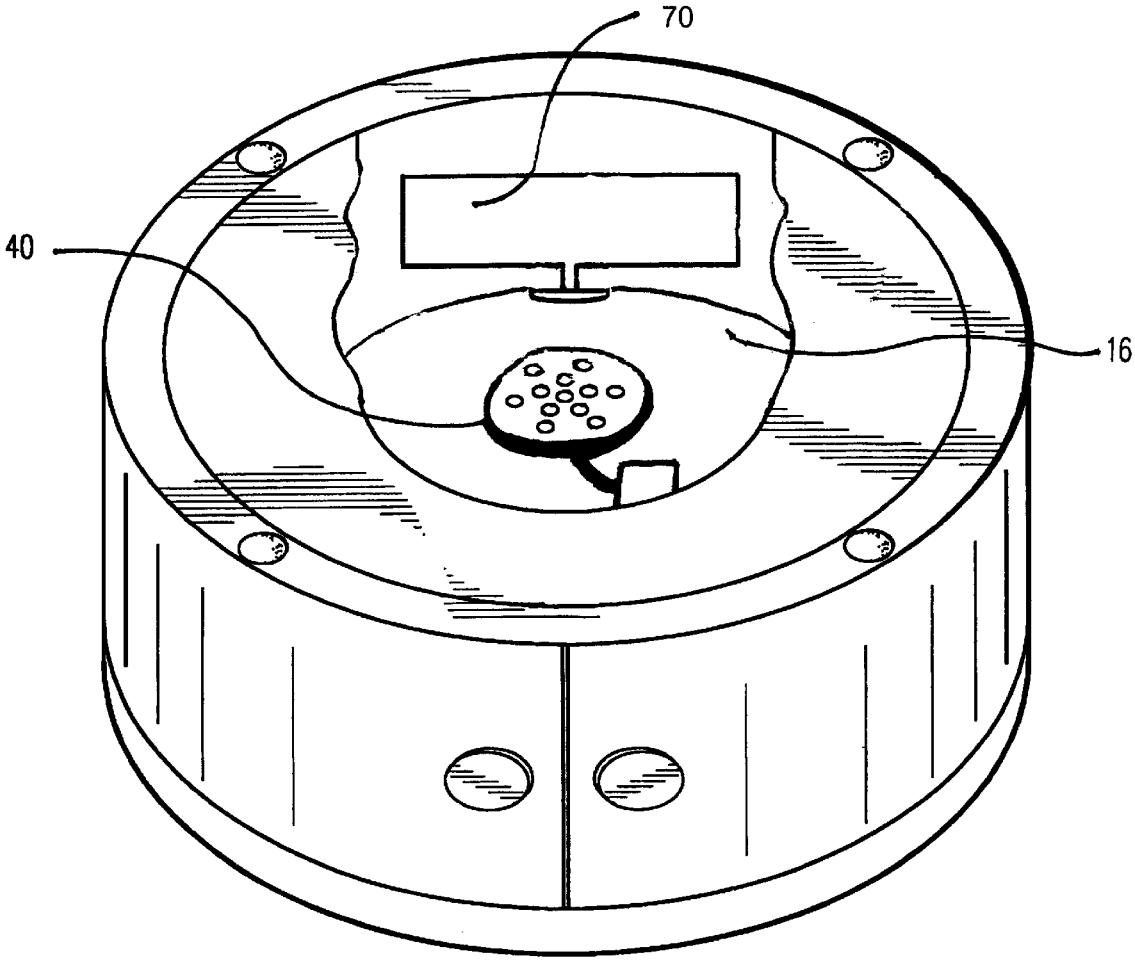
FIG. 6 is a bottom perspective partial cutaway view of the base of the embodiment of FIG. 1, showing an optional music player and motor drivingly connected to the top plate.

To provide easy accessibility to the various hair accessories stored on the invention, the top plate 16 is preferably rotatably mounted on the base 10. Alternatively, the top plate 16 may be immovably mounted on the base 10. Optionally, as shown on FIG. 6, the invention can be fitted with a music player 40, which can play various types of pre-recorded music when the top plate 16 rotates. The music player 40 can be a number of devices including, but not limited to a music box, an integrated circuit, and any other devices that can play music in desired media formats. Optionally, also as shown on FIG. 6, a motor 70 can be drivingly attached to either the top plate 16 or the base 10 such that the top plate 16 rotates automatically under the direction of the user. In FIG. 6, the motor 70 is shown drivingly attached to the top plate 16.

INDUSTRIAL APPLICABILITY

This invention can be used whenever it is desired to store, display, and organize a wide variety of hair accessories.

What is claimed is:

1. A device comprising:

a base;

a top plate rotatably mounted on said base;

a hollow member having a lower end and an open upper end, said lower end being substantially centrally mounted on said top plate;

a plurality of pillars, each of said pillars being spaced apart from each other and each of said pillars being mounted on said top plate;

a removable top having an aperture configured to receive said open upper end of said hollow member, whereby said top is removably mounted on said open upper end of said hollow member and solely supported above said top plate by said hollow member by placing said aperture over said open upper end of said hollow member; and a plunger adapted to be received in and withdrawn from said hollow member, comprising a rod having a first end and a second end, and a platform having a top surface, wherein said first end of said rod is affixed to said top surface of said platform, whereby said plunger can be inserted into said open upper end of said hollow member.

2. A device comprising:

a base;

a top plate rotatably mounted on said base, said top plate having an approximately central recess and a plurality of outer recesses spaced apart from each other;

a hollow member having a lower end and an open upper end, said lower end being adapted to be received by and retained in said central recess, whereby said hollow member is mounted on said top plate by inserting said lower end into said central recess;

a plurality of pillars, each of said pillars being adapted to be mounted on said top plate by being inserted in said outer recesses;

a removable top having an aperture configured to receive said open upper end of said hollow member, whereby said top is removably mounted on said open upper end of said hollow member and solely supported above said top plate by said hollow member by placing said aperture over said open upper end of said hollow member; and a plunger adapted to be received in and withdrawn from said hollow member, comprising a rod having a first end and a second end, and a platform having a top surface, wherein said first end of said rod is affixed to said top surface of said platform, whereby said plunger can be inserted into said open upper end of said hollow member.

3. A device according to claim 2, further comprising a music player operably connected to said base, whereby said music player plays music when said top plate rotates.

4. A device according to claim 2, wherein said hollow member is substantially transparent.

5. A device comprising:

a base having a base compartment;

a top plate rotatably mounted on said base, said top plate having an approximately central recess and a plurality of outer recesses spaced apart from each other;

a hollow member having a lower end and an open upper end, said lower end being adapted to be received by and retained in said central recess, whereby said hollow member is mounted on said top plate by inserting said lower end into said central recess;

a plurality of pillars, each of said pillars being adapted to be mounted on said top plate by being inserted in said outer recesses;

a removable top having a plurality of top compartments, said top having an aperture configured to receive said open upper end of said hollow member, whereby said top is removably mounted on said open upper end of said hollow member and solely supported above said top plate by said hollow member by placing said aperture over said open upper end of said hollow member; and a plunger adapted to be received in and withdrawn from said hollow member, comprising a rod having a first end and a second end, and a platform having a top surface, wherein said first end of said rod is affixed to said top surface of said platform, whereby said plunger can be inserted into said open upper end of said hollow member.

6. A device according to claim 5, further comprising a music player operably connected to said base, whereby said music player plays music when said top plate rotates.

7. A device according to any one of claim 5 or 6, wherein said hollow member is substantially transparent.

* * * * *